US009921005B2

(12) United States Patent
Bluetling et al.

(10) Patent No.: US 9,921,005 B2
(45) Date of Patent: Mar. 20, 2018

(54) HEAT EXCHANGER WITH SEALED GASKET CARRIER PLATE

(75) Inventors: Jens Bluetling, Langenfeld (DE); Werner Buntz, Muehlhausen I.T. (DE); Jochen Salzmann, Neu-Ulm (DE)

(73) Assignees: Dana Canada Corporation, Oakville (CA); Dana GmbH, Neu-ulm (DE)

( * ) Notice: Subject to any disclaimer, the term of this patent is extended or adjusted under 35 U.S.C. 154(b) by 745 days.

(21) Appl. No.: 13/261,700

(22) PCT Filed: Feb. 1, 2012

(86) PCT No.: PCT/EP2012/000446
§ 371 (c)(1),
(2), (4) Date: Oct. 1, 2013

(87) PCT Pub. No.: WO2012/104077
PCT Pub. Date: Aug. 9, 2012

(65) Prior Publication Data

US 2014/0020866 A1 Jan. 23, 2014

(30) Foreign Application Priority Data

Feb. 1, 2011 (DE) ..... 20 2011 002 197 U

(51) Int. Cl.
*F28D 7/02* (2006.01)
*F28F 3/12* (2006.01)
(Continued)

(52) U.S. Cl.
CPC ..... *F28F 3/00* (2013.01); *F01M 5/002* (2013.01); *F28D 9/005* (2013.01); *F28F 9/0246* (2013.01);
(Continued)

(58) Field of Classification Search
CPC ..... F01M 2011/031; F01M 2011/033; F28F 2280/06; F01P 3/04
(Continued)

(56) References Cited

U.S. PATENT DOCUMENTS 3,559,730 A * 2/1971 Denjean ..... F16L 5/10 165/158
3,703,925 A * 11/1972 Ireland ..... F28F 1/28 165/151
(Continued)

FOREIGN PATENT DOCUMENTS

DE 3913100 A1 * 10/1990 ..... F28D 9/0043
DE 39 13 100 C2 2/1994
(Continued)

OTHER PUBLICATIONS

Translation of German Patent Document DE 102007030563 A1 named DE 102007030563 A1-Translation, translated Jan. 2016.*
(Continued)

*Primary Examiner* — Len Tran
*Assistant Examiner* — Paul Alvare
(74) *Attorney, Agent, or Firm* — Marshall & Melhorn, LLC

(57) ABSTRACT

A heat exchanger has a heat exchanging element with a first terminal plate closing the heat exchanging element on one of its sides and with at least one opening provided with a socket for fluids for the heat exchanger element. At least a first gasket carrier plate has a first lateral face arranged adjacent to the first terminal plate and an opposite second lateral face. The first gasket carrier plate has at least one passage opening leading from the first to the second lateral face for taking up at least one socket of the first terminal plate. A first sealing element is provided between the first terminal plate and the first gasket carrier plate. A second sealing element is pro-
(Continued)

vided adjacent to the second lateral face. The at least one socket of the first terminal plate is bulged outwardly to adjoin to the second sealing element at least in sections.

18 Claims, 12 Drawing Sheets

(51) Int. Cl.

| | |
|---|---|
| ***F16L 39/00*** | (2006.01) |
| ***F16L 41/00*** | (2006.01) |
| ***F16L 45/00*** | (2006.01) |
| ***F16L 51/00*** | (2006.01) |
| ***F16L 13/14*** | (2006.01) |
| ***F16L 19/04*** | (2006.01) |
| ***F16L 19/08*** | (2006.01) |
| ***F28F 3/00*** | (2006.01) |
| ***F01M 5/00*** | (2006.01) |
| ***F28D 9/00*** | (2006.01) |
| ***F28F 9/02*** | (2006.01) |
| *F28F 9/00* | (2006.01) |
| *F28D 21/00* | (2006.01) |

(52) U.S. Cl.
CPC ..... *F28D 2021/0089* (2013.01); *F28F 9/002* (2013.01); *F28F 2230/00* (2013.01); *F28F 2280/06* (2013.01)

(58) Field of Classification Search
USPC ..... 165/167, 906, 911; 285/139.2, 133.3, 285/215, 382.4, 382.5
See application file for complete search history.

(56) References Cited

U.S. PATENT DOCUMENTS

| | | | | |
|---|---|---|---|---|
| 3,917,291 | A * | 11/1975 | O'Neill | F28D 19/047 165/9 |
| 4,062,394 | A | 12/1977 | Anderson | |
| 5,575,330 | A * | 11/1996 | Hoeffken | F24H 9/14 126/110 R |
| 6,250,380 | B1 | 6/2001 | Strahle et al. | |
| 7,533,717 | B2 | 5/2009 | Hummel et al. | |
| 7,717,164 | B2 | 5/2010 | Richter | |
| 2004/0194941 | A1* | 10/2004 | Larrieu | F02K 9/64 165/170 |
| 2004/0211550 | A1* | 10/2004 | Finch | F28F 3/083 165/167 |
| 2007/0289724 | A1* | 12/2007 | Hoof | F28D 9/005 165/149 |
| 2010/0206516 | A1 | 8/2010 | Mueller-Lufft et al. | |
| 2012/0061060 | A1 | 3/2012 | Stoll et al. | |

FOREIGN PATENT DOCUMENTS

| | | | | |
|---|---|---|---|---|
| DE | 103 49 141 | A1 | 5/2005 | |
| DE | 20 2006 018968 | U1 | 3/2007 | |
| DE | 10 2007 030 563 | A1 | 1/2009 | |
| DE | 102007030563 | A1 * | 1/2009 | F28D 9/005 |
| DE | 10 2007 052 706 | A1 | 5/2009 | |
| EP | 1 522 811 | A2 | 4/2005 | |
| EP | 1 870 570 | A2 | 12/2007 | |
| EP | 1 876 406 | A1 | 1/2008 | |
| GB | 885 992 | A | 3/1962 | |
| GB | 1302516 | | 1/1973 | |
| WO | 2006/042405 | A1 | 4/2006 | |
| WO | WO 2008/006177 | A1 | 1/2008 | |
| WO | WO 2009/100861 | A1 | 8/2009 | |
| WO | 2010/136108 | A2 | 12/2010 | |

OTHER PUBLICATIONS

Office Action issued in corresponding German Application No. 11 2012 000 637.2 dated Aug. 11, 2017.

* cited by examiner

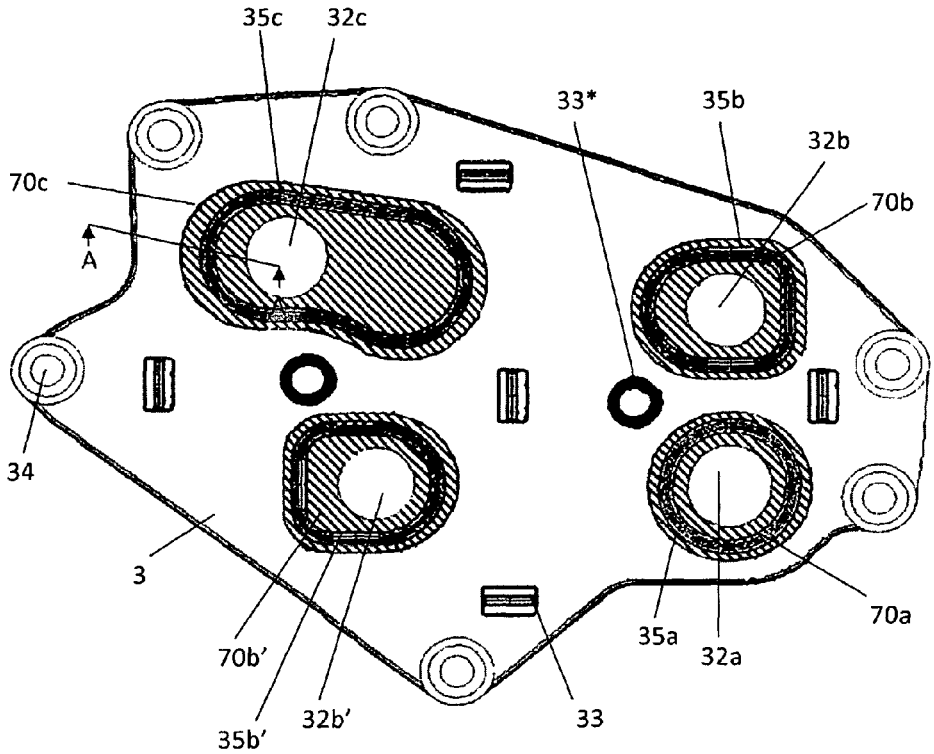
Fig. 14-a
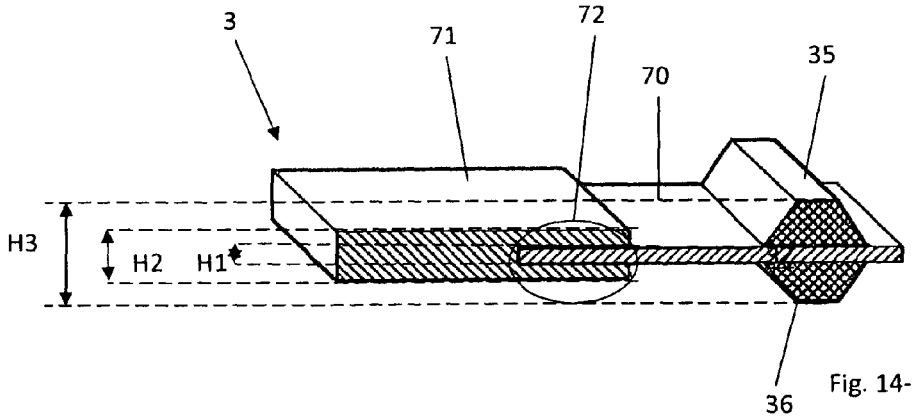
Fig. 14-b
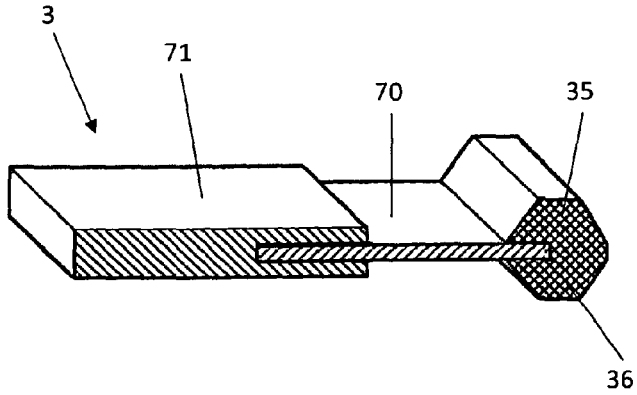
Fig. 14-c

HEAT EXCHANGER WITH SEALED GASKET CARRIER PLATE

BACKGROUND OF THE INVENTION

The present invention relates to a heat exchanger, especially to an oil cooler for vehicles.

Such oil coolers are typically used for cooling of engine oil, for instance in an oil/oil cooler or in an oil/water cooler. As is for example described in DE 103 49 141 A1, such oil coolers are often designed as heat exchangers with stacked plates. To this end, the oil cooler comprises a heat exchanger element with individual stacked plates. The passages created between adjacent plates define the flow channels of both fluid media: The medium releasing heat and the medium taking up heat. Additionally, turbulizers or fins may be inserted between the stacked plates, to serve as heat transfer augmentation or structural support devices. The stacked plates are connected to each other, especially by brazing. Typically the plates are made of a metal that provides pre-placed filler metal for brazing, for example aluminum brazing sheet. Such a heat exchanger may however also have a completely different configuration, e.g. pairs of individual plates may have parallel flanged edges that are similarly joined by brazing, that may be ribbed or dimpled in form or again contain turbulizers inserted between them, and that when stacked together may be contained within a housing.

The stacked plate heat exchangers as described above comprise—at least on one of the termini of the stack—an end plate with inlets and outlets for media. In addition to the end plate, such conventional oil heat exchangers comprise a flange plate, also referred to as a mounting plate, or a facial base plate, by which the oil heat exchanger is sealingly mounted on a part, such as an engine or another part, in such a way that communication means are established for the fluid media to be transferred between the engine or other part, and the heat exchanger inlets and outlets. This flange plate is typically brazed onto the heat exchanger during the heat exchanger assembly process, again to maintain sealed fluid media communication passageways to the heat exchanger stack.

Because the oil supply system in many internal combustion engines involves relatively high pressure cyclic loads, often in combination with induced vibration loads, the flange or facial base plate must be very rigid to minimize deflection forces on the attached heat exchanger stack; and to maintain seal integrity. This often requires the use of heavy gauge metal flange plates, which complicate brazing due to the mass differences between the facial base plate, and the much thinner gauge heat exchanger plates. Also, since elastomer sealing materials cannot survive the brazing temperatures during heat exchanger assembly, subsequent attachment of the flange plate to the engine or other receiving part requires the use of separately applied gasket components.

Such a conventional oil heat exchanger thus requires a laborious sealing in order to guide the medium in a media-tight manner at the connections between the supplying pipes and the oil cooler, especially its end plate. This leads to a complex construction which requires a lot of parts and is cumbersome to be mounted. Furthermore, the use of heavy gauge metal flange plates is costly in material, and adds significant complexity to the heat exchanger brazing process.

BRIEF SUMMARY OF THE INVENTION

It is therefore the object of the present invention to provide for a heat exchanger which can be produced in a simple and cost-efficient manner and which can be mounted more simply, with reduced cost and complexity.

This object is solved by an improved heat exchanger structure according to claim 1. Advantageous embodiments of the heat exchanger according to the invention are given in the dependent claims.

The heat exchanger according to the present invention comprises a heat exchanger element, in which heat is exchanged between two or three media, especially between oil and oil or oil and water, and in particular between engine oil and glycol-water based engine coolants. The heat exchanger element comprises at least a first terminal plate with openings for supply and discharge of at least one fluid medium into or out of the heat exchanger element. At least one, several or all of the openings comprise fluid port fittings or sockets.

In an advantageous embodiment, the heat exchanger element comprises a second terminal plate arranged on the side opposite to the first terminal plate, which second terminal plate comprises openings for the supply and/or discharge of a fluid medium into or out of the heat exchanger element. These openings may be provided with sockets, too. The second terminal plate may in general be designed in the same way as the first one.

A first gasket carrier plate is arranged adjacent to the first terminal plate, where said gasket carrier plate comprises passage openings adapted to the ones in the first terminal plate. These passage openings allow for the insertion of the at least one socket of the first terminal plate, into or through the gasket carrier plate. The first gasket carrier plate is thus installed on the first terminal plate in such a way that its first passage openings receive the sockets in the first terminal plate.

At least one first sealing element is arranged between the first terminal plate and the first gasket carrier plate. This first sealing element completely encircles the edge of the passage opening itself or of a passage opening taking up a socket and seals the passage opening between the first terminal plate and the first gasket carrier plate. On the surface of the gasket carrier plate facing outward, a further sealing element is arranged, which also circumvents the passage opening or its edge on the outwardly facing surface completely. This second sealing element seals the respective passage opening between the heat exchanger and a further part to which it is mounted.

Advantageously, the sealing elements are moulded onto the gasket carrier plate or are inserted into recesses or grooves in the gasket carrier plate. Moulding of the elastomer, or optionally of profiled sealing elements, is usually done by resin transfer moulding, extrusion or liquid injection moulding. Typical materials used in these processes are fluoropolymers (e.g. FPM, PFA and/or MFA), NBR rubber (e.g. acryl-butadiene rubber), EPDM (ethylene-propylene rubber), ACM (polyacrylate) or EAM (ethylene acrylate).

In an advantageous embodiment of the invention, the socket of the first terminal plate is bulged or expanded in its end section, at the socket end pointing outward from the gasket carrier plate, and after assembly with the carrier plate in order to connect the first terminal plate with the carrier plate.

The gasket carrier plate and heat exchanger according to the invention make it possible that the forces which cause a pressure on the first and second sealing element act in an axial direction, thus in the passage direction of the socket, meaning orthogonal to the contact face between the terminal plate and the gasket carrier plate. This provides for the sealing of the gasket carrier and terminal plate of the heat exchanger. The direction of forces enables a sealing of the gasket carrier plate, the terminal plate and the heat exchanger as a whole. This inventive sealing arrangement is particularly reliable and secure but at the same time simple to realize.

As already mentioned above, the terminus of the heat exchanger opposite to the first terminal plate may be designed in a comparable way.

Each of the gasket carrier plates may also comprise fastening elements, especially fastener through-holes for mounting and attaching the gasket carrier plate onto another part, e.g. by means of screws or bolts. These openings or holes may be situated in an area of the gasket carrier plate which protrudes beyond the outer edge of the terminal plate and which is therefore easy to access for assembly.

Further, in case the heat exchanger is designed with a housing, fastening between the gasket carrier plate and the housing can also be realized via an opening in an area of the gasket carrier plate which protrudes beyond the outer edge of the terminal plate of the stack but which adjoins to the housing. To this end, the housing itself can also comprise a broadened terminal frame which facilitates this fastening.

As already mentioned, one, several or all of the sockets are advantageously bulged on the outer side of the gasket carrier plate. This may be done by bending the outer edge of the socket by an angle $\alpha$ or by folding over this outer edge. Bending angles between 30° and 160°, especially between 30° and 120° are advantageous. The limits mentioned here can be included or excluded.

If a larger part of the terminal edge of the socket is folded over, this folded section may cover at least sections of the second sealing element arranged on the outer surface of the gasket carrier plate. Bending or folding of the socket's edge is particularly easy if the respective edge shows slits. With these slits, folding over produces tabs, which may for instance be situated immediately on the sealing element or adjoin to the latter and in interaction with the sealing element cause an axial sealing.

As an alternative, the edge of the socket may be designed in a saw-toothed manner—as a saw-toothed edge—with these saw teeth being folded over comparable to a crown cap.

The socket may further provide for additional functions, such as integration of a fluid flow mass probe which can allow for control of fluid flow in the heat exchanger.

The gasket carrier plate may advantageously be produced from a polymer material allowing for a tremendous reduction of the weight of the heat exchanger in comparison to a conventional state-of-the-art heat exchanger having a metallic flange plate and additional sealing elements. Besides the weight-related advantages, polymer materials also offer a large variety of advantages with respect to freedom of design. Compared to metallic flange plates, polymer plates allow for designs with ribs for mechanical reinforcement, with domes or frames for fastening or seating parts to which they are to be mounted including the terminal plate of the stack, variations in thickness, integration of reinforcing elements and the like. Moreover, adhesion of e.g. moulded-on sealing elements on polymer flange plates is considerably better than on metallic flange plates. Using polymer flange plates, it is even possible to apply such sealing elements without further pre-treatment, thus without having to apply any primer etc.

Among the polymer materials, thermoplastic materials are advantageous over thermoset materials as they can be worked by injection moulding. Polyamide is a preferred material, especially fibre-reinforced polyamide, with polyamide 6 and polyamide 6.6 being most preferred.

It is also possible that the gasket carrier plate design as described here may consist of a metallic material, e.g. aluminium or steel. Although the weight advantage may be less in this case, the improved attachment features and integrated gaskets in the present gasket carrier plate permits assembly to the heat exchanger after brazing in the same way as the plastic gasket carrier plate. Thus, there is still an advantage in terms of simplified brazing of the heat exchanger, for example to allow a reduction of the treatment time in the brazing oven. Also, die cast metals may be used including aluminum, zinc or magnesium, to accommodate some of the lattice or structural rib reinforcements also described here in relation to plastic materials, to minimize weight penalty.

In an advantageous embodiment of the invention, some or all of the passage openings or through-holes of the gasket carrier plate are reinforced by metallic sleeves, e.g. steel, brass or aluminium sleeves.

In an alternative advantageous embodiment of the invention, the gasket carrier plate is made from polymeric material but comprises metallic inserts. They comprise the actual passage openings for the sockets. These metallic inserts are preferably stamped from metal sheet, especially steel sheet or aluminium sheet and serve as carrier of the actual seals, which are preferably moulded onto both surfaces of the metallic insert or edge-moulded on the metallic insert. The inserts are integrated into the gasket carrier plate during the moulding process of the gasket carrier plate, meaning that the edges of the inserts are covered by the material of the gasket carrier plate. In preferable embodiments, the thickness of the metallic inserts is therefore less than the thickness of the polymeric gasket carrier plate which in turn is less than the thickness of the insert in those areas to which the gaskets or seals are moulded. This also allows for designs in which the height of the seals is adapted to the thickness of the gasket carrier plate, so that the gasket carrier plate can act as a limit stop for the seals, preventing them from excessive compression and fatigue.

Moreover, the use of metallic inserts allows for increased standardization and modular designs by choosing the inserts from a collection of standard inserts. These standard inserts can then be integrated into gasket carrier plates of the most varied of geometries and sizes.

The weight of the gasket carrier plate may further be reduced without sacrificing structural stiffness by providing recesses in its plane, or if it is designed with lattice bars or stiffening ribs within such recesses. With a suitable arrangement of the lattice bars, it is possible to achieve a high level of structural rigidity, while allowing a significant reduction in material.

The gasket carrier plate may incorporate further openings or recesses, especially slits, which may be used to receive tabs or tongues provided on the terminal plate in a complementary manner, so that they serve as an assembly means between the carrier plate and the heat exchanger. After assembly insertion, the ends of these tabs protrude beyond the opposite surface of the gasket carrier plate, and may then be folded over to provide a locking mechanical attachment. This way, they provide for a permanent positive fit or frictional connection of the gasket carrier plate on the terminal plate. It is also possible to do without such further fixation means.

In the following, some examples of the heat exchanger according to the invention are presented. The same or similar reference numbers are used throughout all examples for the same or similar elements so that their description is not repeated in the context of each example. It shall be stressed that each example shows a multitude of elements and characteristics of the invention which may be realized in a heat exchanger according to the invention outside of the context of the accompanying elements of the examples shown. Thus, the following does not only represent combinations of such characteristics, but each of the characteristics described in the following sections can be considered apart and independent of the other characteristics of the respective example.

BRIEF DESCRIPTION OF THE DRAWINGS

In FIGS. 1 to 14, exemplary embodiments of heat exchangers according to the invention are shown.

DETAILED DESCRIPTION OF THE INVENTION

Figure 1:
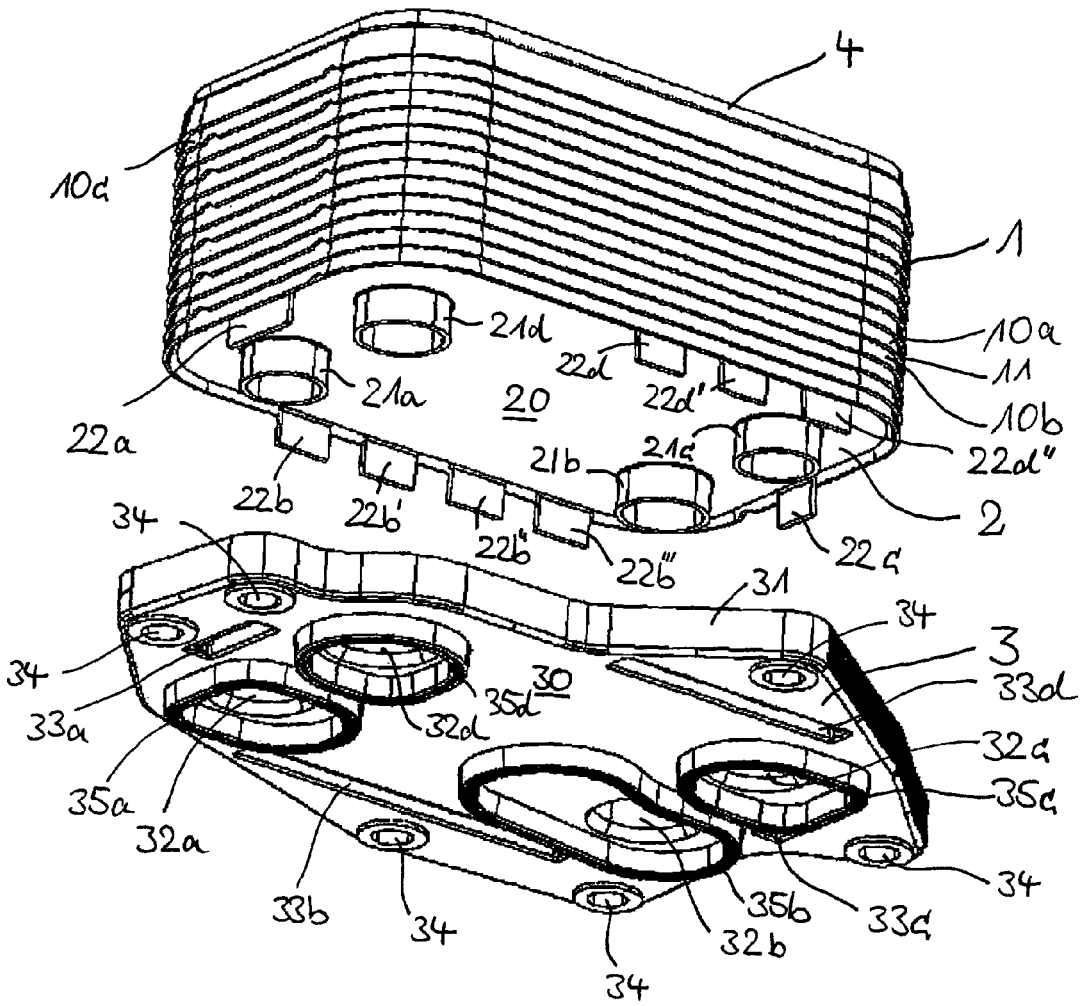

FIG. 1 shows a heat exchanger or heat transfer device 1 of the stacked plates type. It comprises a plurality of stacked plates 10*a*, 10*b*, 10*c*, as well as further stacked plates which are stacked one on the other and brazed to each other along their outer edge. During brazing, the interior surface of one plate is connected to the facing surface of the adjacent plate via interspersed turbulizers, fins or other augmentation devices. The stacked plates in the area limited by the outer edge are thus structured in such a way that they define flowing paths for two fluids between alternating plate pairs, namely the fluid to be heated and the fluid to be cooled.

The stack comprising stacked plates 10*a*, 10*b*, 10*c*, etc. on one of its edges is limited by a lower terminal plate 2 and on the opposite edge is limited by an upper terminal plate 4.

The lower terminal plate 2 comprises a facial base plate 20, including a total of four passage openings, each of which is provided with a downwardly protruding socket 21*a*, 21*b*, 21*c*, 21*d* and which openings are each surrounded by one of the latter ones. Two of these passage openings allow for the supply of the fluid to be heated and the fluid to be cooled while the other two passage openings provide for the outlet of the two fluids. The arrangement of the individual passage openings and the sockets 21*a*, 21*b*, 21*c*, 21*d* results from the design of the stacked plates 10*a*, 10*b*, 10*c*, 10*d* in their inside region.

The facial base plate 20 consists of a metallic material, e.g. a metal sheet, with the sockets being integrally formed from this metal sheet, for instance by deep-drawing. In a comparable way, tabs 22*a* to 22*d*, 22*b*', 22*b*", 22*b*'", 22*d*', 22*d*" are formed from the material of the facial base plate 20. These tabs provide for an additional connection of a gasket carrier plate 3 onto the terminal plate 2.

In a heat exchanger according to the present invention, the stack based on stacked plates typically shows a width of 50 to 150 mm, a length of 70 to 300 mm as well as a height of 20 to 150 mm and a gasket carrier plate with a width of 80 to 200 mm, a length of 100 to 300 mm and a height of 5 to 15 mm. Typical dimensions are 70 mm×110 mm×0 mm for the cooler stack and 110 mm×150 mm×7 mm for the gasket carrier plate, or 70 mm×140 mm×50 mm for the cooler stack and 100 mm×160 mm×7 mm for the gasket carrier plate or—especially when used in commercial vehicles, such as trucks—110 mm×200 mm×105 mm for the cooler stack and 160 mm×250 mm×10 mm for the gasket carrier plate.

In the exploded view of FIG. 1, which corresponds to the non-installed state of the heat exchanger, an additional gasket carrier plate 3 made from plastic is shown from its bottom side. This gasket carrier plate 3 comprises a facial base plate 30. This facial base plate 30 comprises a circumferential edge 31. The facial base plate comprises passage openings 32*a* to 32*d*, which are positioned corresponding to the passage openings and sockets 21*a* to 21*d* in the terminal plate 2. Each of the passage openings 32*a* to 32*d* is encircled by a circumferential elastomeric sealing element 35*a* to 35*d*, which is moulded in place. The terminal plate further shows slit-shaped openings 33*a* to 33*d* corresponding to the locations of the tabs 22*a* to 22*d*, 22*b*', 22*b*", 22*b*'", 22*d*' and 22*d*". The slot or slit opening 33*a* is suited for receiving the tab 22*a*, which after insertion through this slit 33*a*, can be folded-over. The slit 33*b* is similarly located and sized for receiving the tabs 22*b*, 22*b*', 22*b*" and 22*b*'". These tabs can be folded over, too, after having been inserted through the slit 33*b*. The slit 33*c* is suited for taking up the tab 22*c*, while the slit 33*d* is provided to receive the tabs 22*d*, 22*d*' and 22*d*". These tabs are folded-over after assembly of the gasket carrier plate 3 to the terminal plate 2 and this way provide for a secure positive fit connection of the gasket carrier plate 3 on the terminal plate 2. Since the terminal plate 2 is brazed to the heat exchanger, in this way the entire heat exchanger stack is mechanically locked to the gasket carrier plate 3.

The gasket carrier plate 3 has, in particular regions such dimensions that it protrudes beyond the outer edge of the terminal plate 2. In these regions, bores or passages 34 are arranged through which bolts can be inserted in order to fasten the gasket carrier plate 3 to another part. The heat exchanger 1 according to the invention in this way can be fastened to another part.

Figure 2:
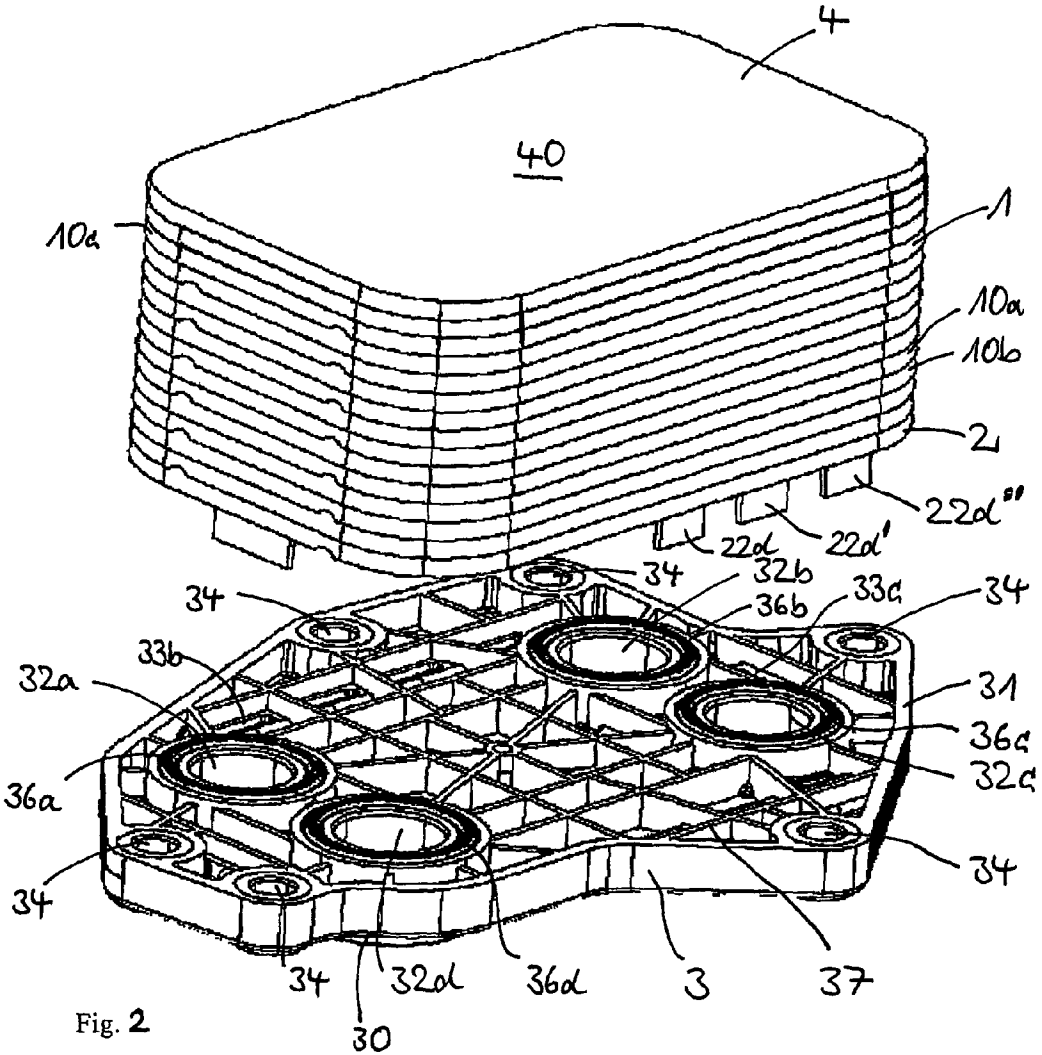

FIG. 2 now shows the same heat exchanger 1 but from a different point of view. FIG. 2 allows viewing of the second terminal plate 4 of the heat exchanger, which here is formed as a cover plate 40 without openings.

The top view of the surface of the gasket carrier plate 3 pointing towards the heat exchanger plate stack shows that this gasket carrier plate is formed with ribs in order to reduce its weight. It thus shows internal ribs or webs 37, with the interspaces of these ribs being free of material. Nevertheless, the gasket carrier plate 3 as shown in FIG. 1 has a closed surface, which is only perforated by the passage openings 32*a* to 32*d*, the slits 33*a* to 33*d* and the bolt holes 34.

On the side of the gasket carrier plate 3 pointing towards the heat exchanger plate stack and the terminal plate 2 in FIG. 2, the passage openings 32*a* to 32*d* are encircled by annular sealing elements 36*a* to 36*d*, which are arranged in grooves formed in the gasket carrier plate 3.

Figure 3:
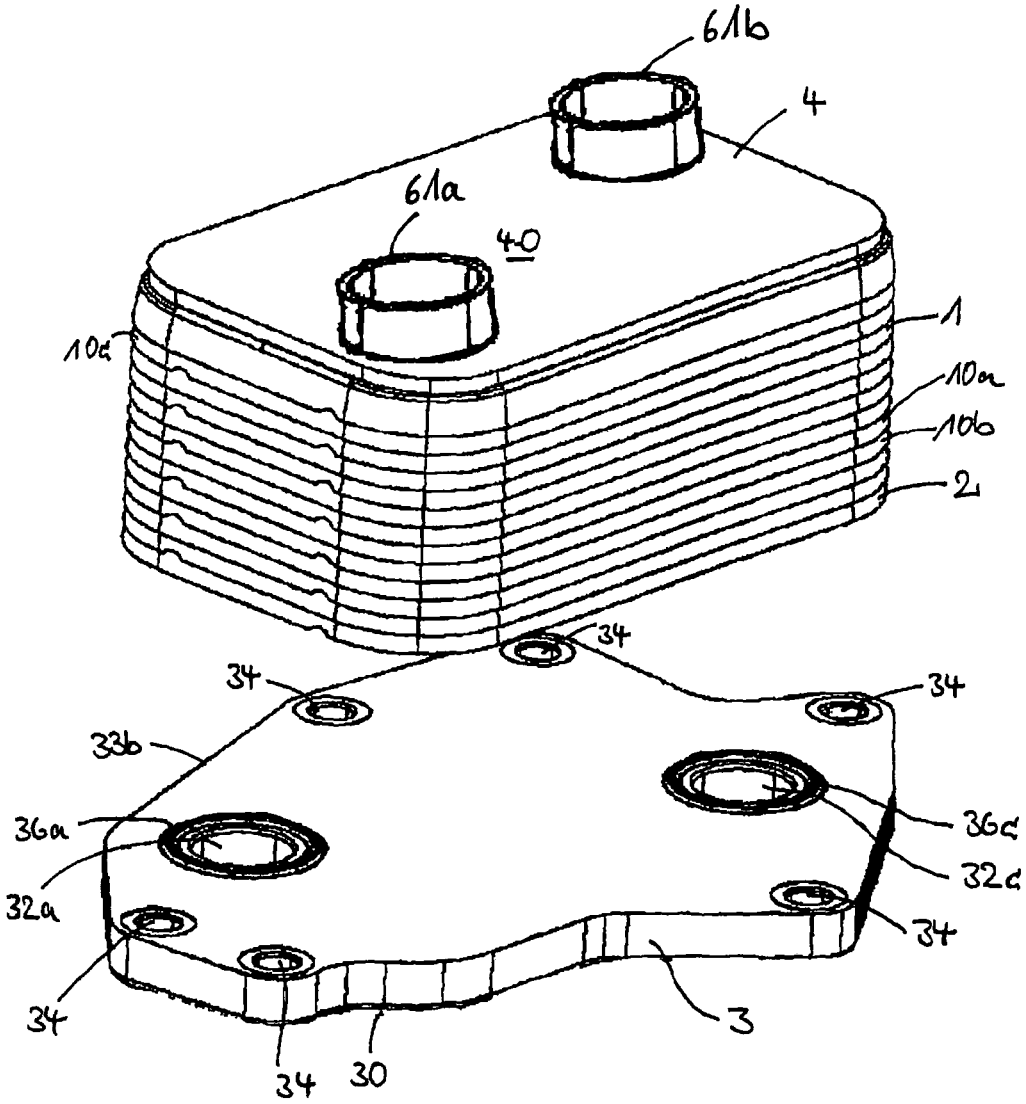

FIG. 3 shows a similar heat exchanger as FIGS. 1 and 2. In contrast to the example in FIGS. 1 and 2, the lower terminal plate 2 and the gasket carrier plate 3 are provided with two passage openings, while the upper terminal plate 4 is designed in such a way that two sockets 61*a*, 61*b* protrude beyond its closed surface 40 and in this way provides for the inlet—and outlet flow of the heat exchanging fluids. Other necessary in—and outlet communication of the heat exchanging fluids is enabled by passage openings 32*a* and 32*c* in the lower gasket carrier plate 3. Here, the gasket carrier plate is formed as a solid plate without webs. In one alternative embodiment, fastening of the gasket carrier plate is accomplished via bulging, swaging or expansion of the sockets, which allows for an attachment means without tabs 22 and slit openings 33. Besides, the design of the terminal plate 2 and of the gasket carrier plate 3 corresponds to the one shown in FIG. 1.

Figure 4:
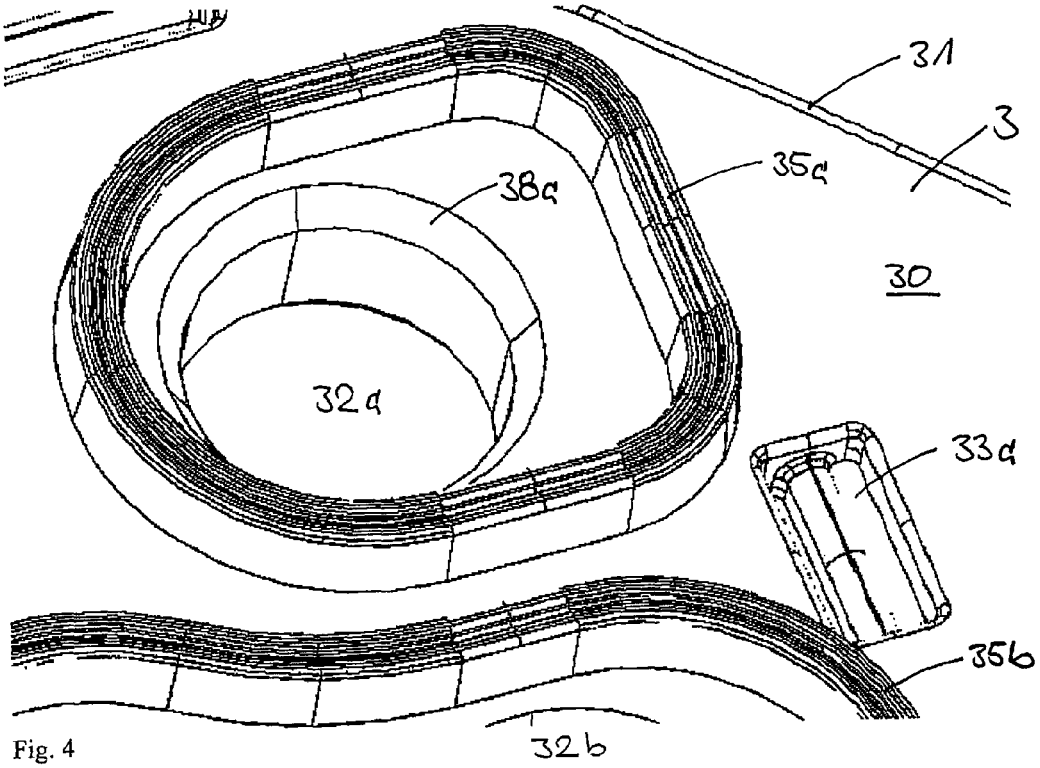

FIG. 4 shows a magnified section of the gasket carrier plate shown in FIGS. 1 to 3, in particular a detail section around the passage opening 32*c*. The view shown here corresponds to an inverted view of the one in FIG. 1.

In FIG. 4, one can observe that the upper edge of a passage opening 32 in the facial base plate 30, and in particular at its transition from the through-opening 32*c* to the surface of the plate 30 facing away from the plate stack, is bevelled. This chamfer enables, as will be described below, connecting of the socket 21*c* to the gasket carrier plate 3.

Figure 5:
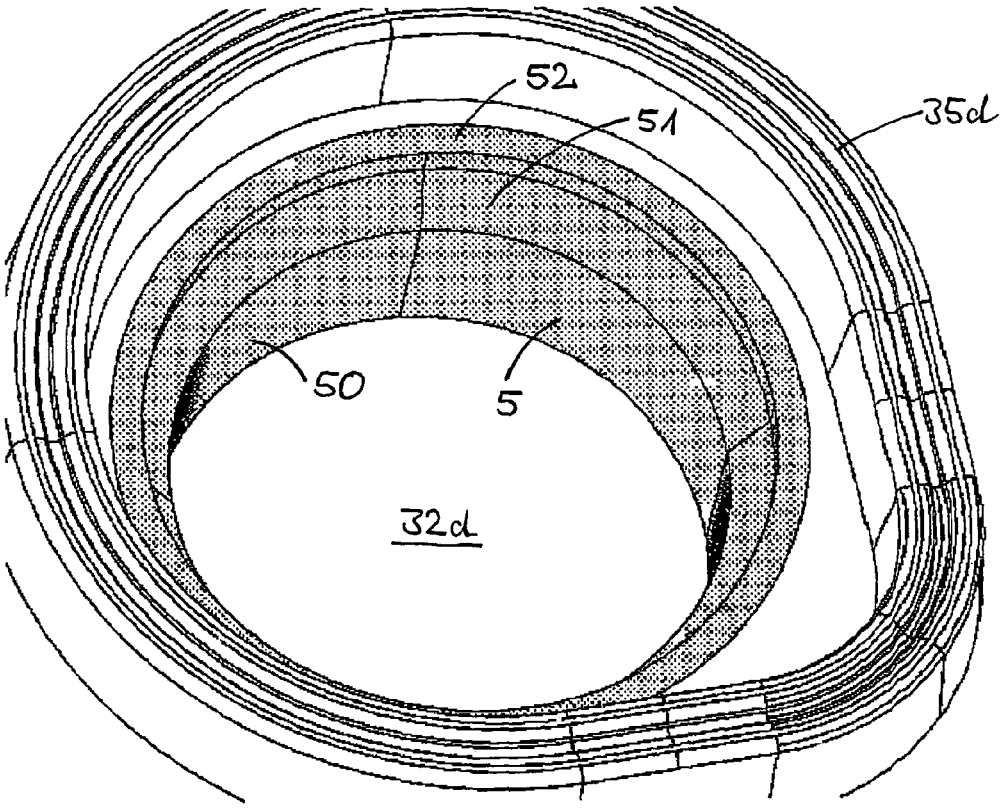

FIG. 5 shows a section of the gasket carrier plate 3 according to an alternative embodiment, comparable to the area around the passage opening 32*d* shown in FIG. 1. Here, a metal sleeve 5 has been inserted into this passage opening. This sleeve 5 includes a wall 50, which lines the passage opening 32*d*. At its end corresponding to the surface of the facial base plate 30 that faces away from the plate stack, the sleeve 5 comprises a hem 52, which is seated on this facial base plate surface. An inclination 51 is arranged between the inner wall surface of the sleeve 5, and the hem 52. This inclination 51 corresponds in function to the chamfer or bevelled edge 38*c* at the passage opening 32*c* shown in FIG. 4. All in all, this causes that the sleeve 5 is firmly fastened in the passage opening 32*c*.

Figure 6:
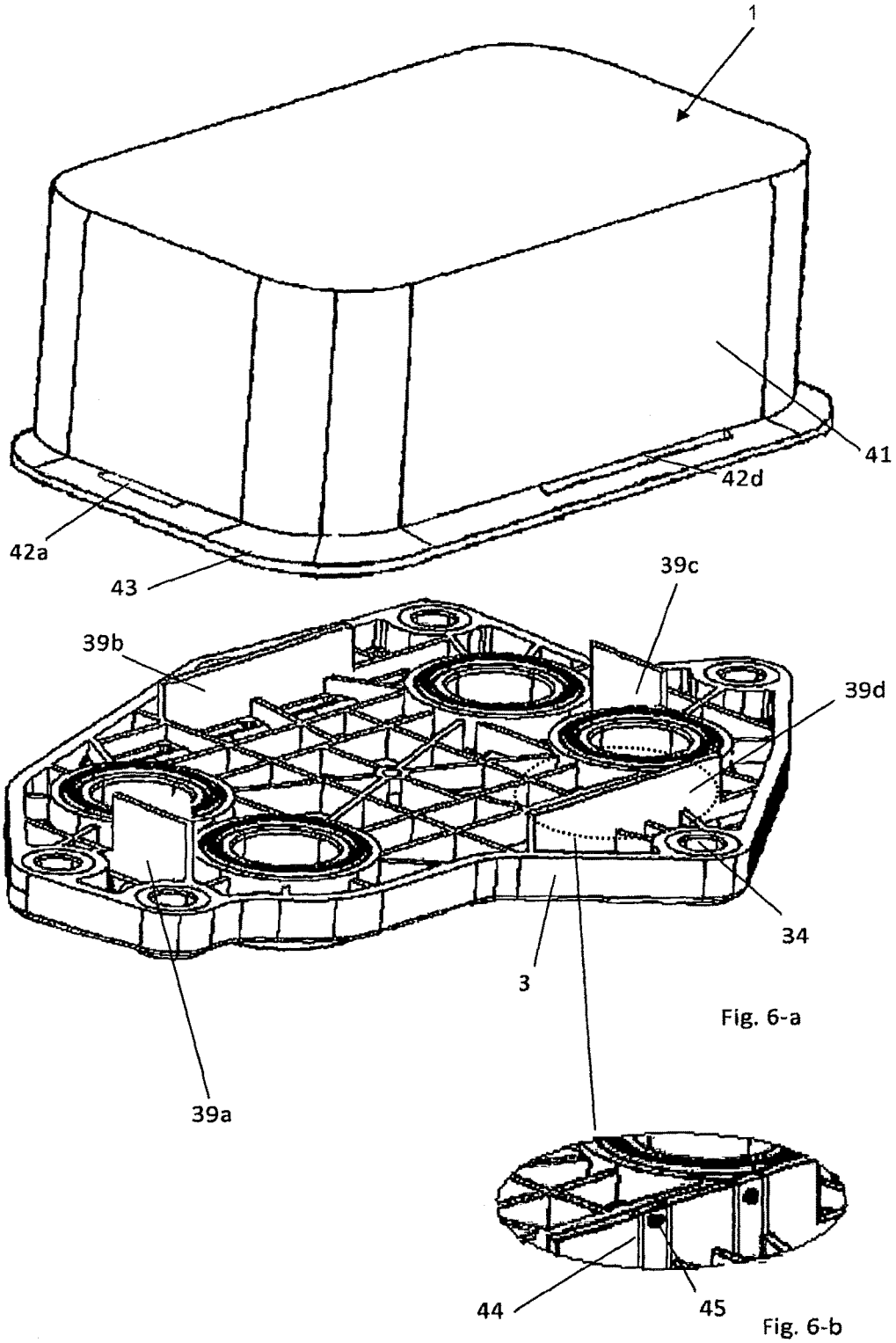

FIG. 6—a shows an alternative embodiment of the heat exchanger 1 of the invention. Here, the plate stack is arranged in a housing 41, which is only open on one side, the side facing towards the gasket carrier plate 3. The gasket carrier plate 3 essentially corresponds to the gasket carrier plate depicted in FIGS. 1 and 2 so that most of the reference numbers are not repeated in FIG. 6. The gasket carrier plate 3 additionally comprises protrusions or tabs 39*a* to 39*d* which allow the gasket carrier plate to be mounted to the housing 41. The housing 41 at its open side comprises a circumferential collar 43 which can also be considered as a flange. In this collar, four recesses—of which only the two recesses 42*a* and 42*d* are visible here—are provided which take up the protrusions 39*a* (in recess 42*a*), 39*b*, 39*c* and 39*d* (in recess 42*d*) of the gasket carrier plate 3. The protrusions 39*a*, 39*b*, 39*c* and/or 39*d* can be designed with slits 44 and barbed hooks 45 in order to allow for a loss-proof but reversible mouting of the gasket carrier plate 3 on the housing 41, as can be seen in FIG. 6-*b*. In addition, the gasket carrier plate 3 can be mounted to another part via the fastening holes 34 (only one fastening hole being provided with reference numeral in FIG. 6-*a*), which are situated in a region of the gasket carrier plate 3 protruding beyond the outer edge of the housing 41. The housing 41 can for instance be deep-drawn from a metal sheet.

Figure 7:
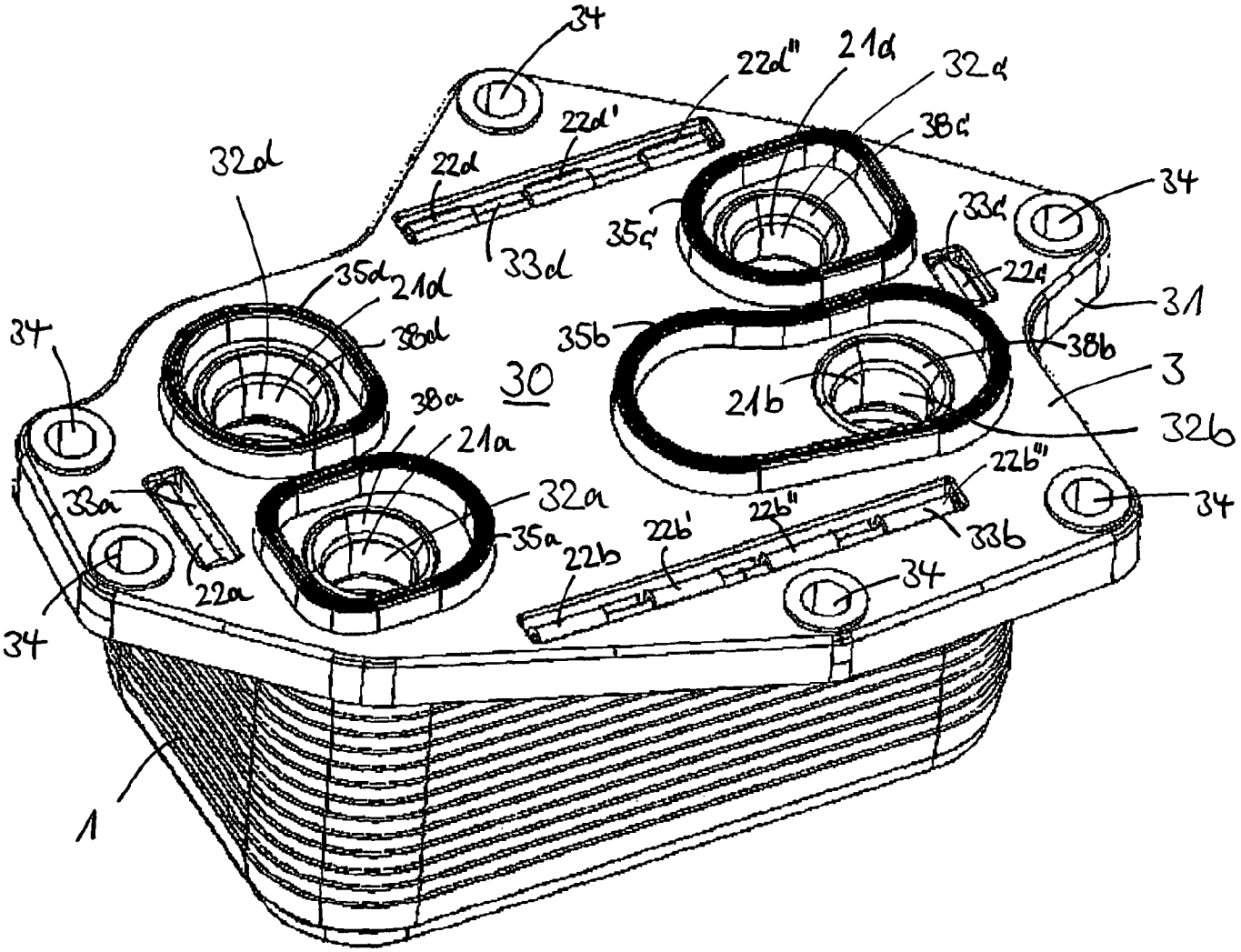

FIG. 7 shows a view of the bottom side of the heat exchanger 1 in the fully assembled state.

The sockets 21*a* to 21*d* are inserted into the passage openings 32*a* to 32*d*. The socket ends that point away from the plate stack are then expanded radially outwards, or swaged against the wall of the openings, to lock the heat exchanger assembly 1, to the gasket carrier plate 3. The bulging or swaging action forces the socket material against the chamfered edges of the openings 21*a* to 21*d*, where said chamfered edges are identified as reference numbers 38*a* to 38*d*. This clamping of the gasket carrier plate 3 via the bulged sockets 21*a* to 21*d* to the terminal plate 2 causes an axial force—a force in a direction parallel to the longitudinal axis of the opening through holes 21*a* to 21*d* or a force orthogonal to the contact plane between the terminal plate 2 and the gasket carrier plate 3—on the gasket carrier plate 3, which causes the sealing of the mating plates 2 and 3 via compression of the sealing elements 36*a* to 36*d*.

In addition, the slits 33*a* to 33*d* contain a lateral step in the side-walls of their through-openings. In the fastened gasket carrier plate 3 shown in FIG. 6, the tabs 22*a* to 22*d*, 22*b*', 22*b*", 22*b*"', 22*d*' and 22*d*" have been inserted into the passage openings 33*a* to 33*d* and after that have been folded over at the respective lateral step mentioned. This causes a positive fit connection of the terminal plate 2 to the gasket carrier plate 3. In contrast to foregoing embodiments, here no tabs protrude from the surface of the gasket carrier plate 3.

Figure 8:
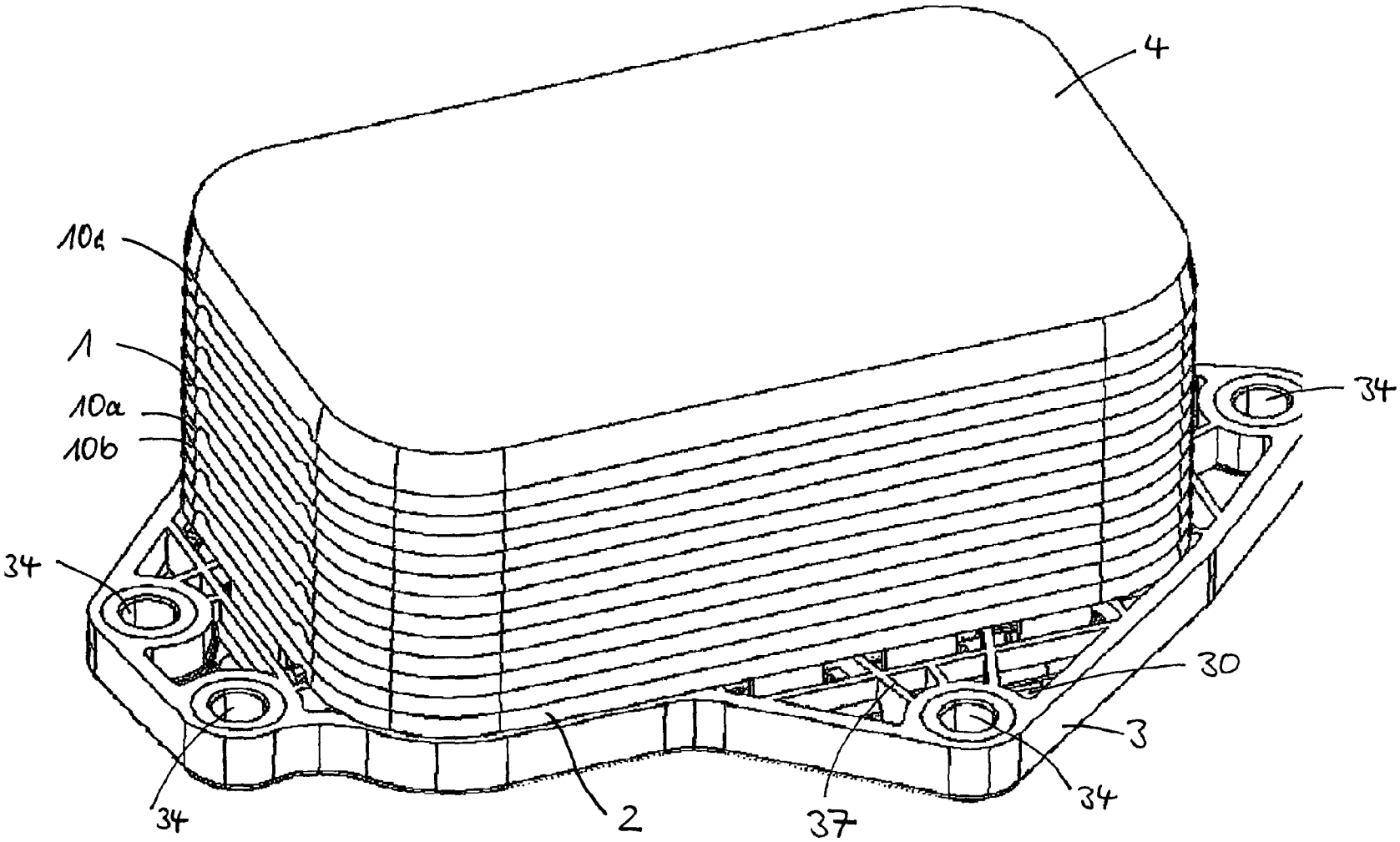

FIG. 8 shows the same heat exchanger as FIG. 7, but now with a view to the upper terminal plate 4. The gasket carrier plate now is shown from its ribbed side with ribs 37 visible in this view. The gasket carrier 3 protrudes laterally beyond the edges of the terminal plate 2, to accommodate fastener holes, 34. These fastening openings are used for fastening the gasket carrier plate 3 and therefore the heat exchanger 1 as a whole, to the engine or another part, for example by means of bolt fasteners.

Figure 9:
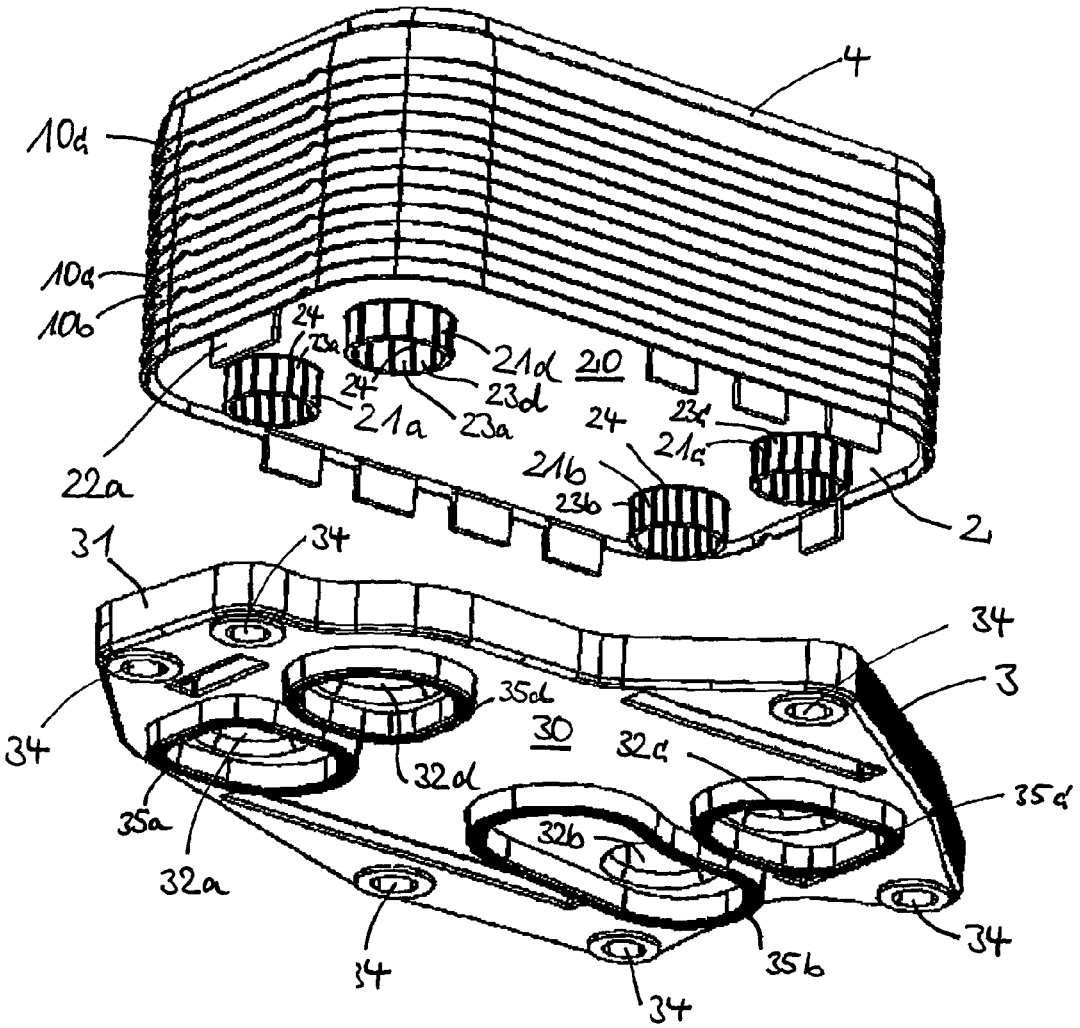

FIG. 9 shows another heat exchanger 1 according to the invention, which is basically designed in the same way as the heat exchangers depicted in FIGS. 1 to 8.

In contrast to these heat exchangers, here the sockets 21*a* to 21*d* are slit; that is, the outward ends of these sockets have slit sidewalls, which are provided to aid in socket swaging to the gasket carrier plate. These slits, some of which are referenced to with reference number 24, extend a predetermined length from the free end of the socket in the direction towards the facial base plate 20 of the terminal plate 2. The slits may extend in length as far as the surface of facial base plate 20. However it is also possible that shorter length slits 24, corresponding to only the end region of the sockets 21*a* to 21*d*, are provided. Between the slits 24, individual elements protruding from the facial base plate 20 result. For each of the sockets 21*a* to 21*d*, one of these individual elements remaining between the slits is referenced to with reference numbers 23*a*, 23*b*, 23*c* and 23*d*, respectively. Sealing of the fluids through the gasket carrier plate is done with the sealing elements 35. This allows to optimizing the sockets and their slits only for fastening purposes and without the need for considering sealing aspects.

The sockets 21*a* to 21*d* after insertion into the passage openings 32*a* to 32*d* can be bulged in a particularly simple manner at their respective free end and this way be clamped to the gasket carrier plate 3.

Figure 10:
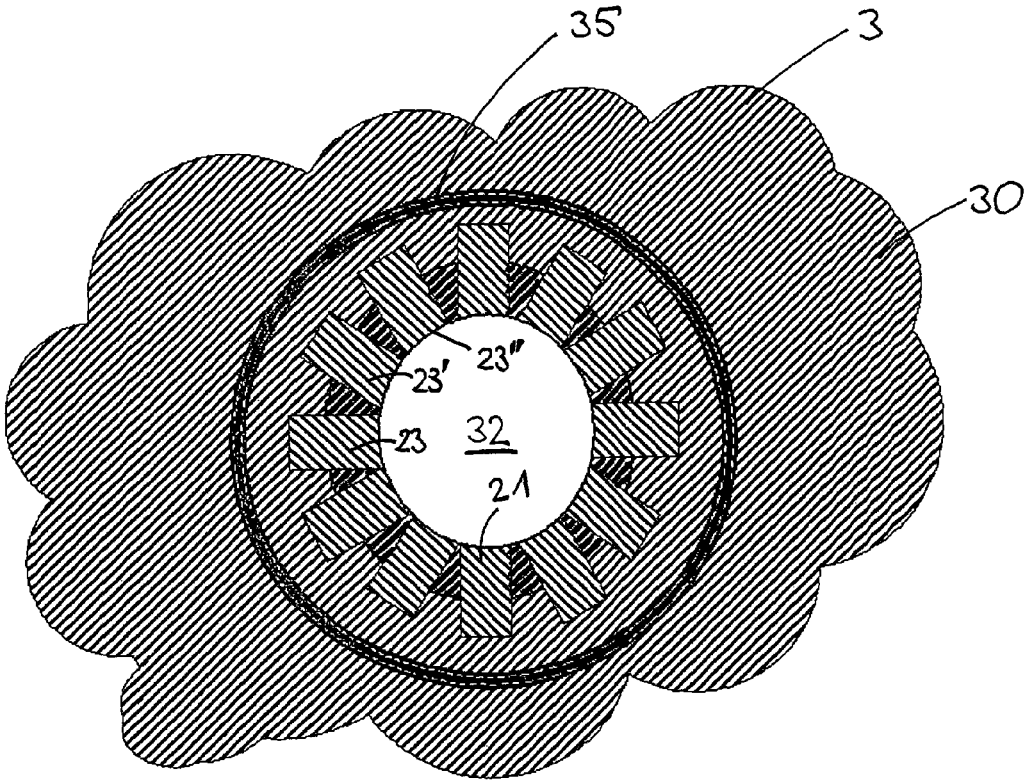

FIG. 10 shows a plan view of a passage opening, which represents passage openings 32*a* to 32*d* and is referenced to here as passage opening 32. Similarly, the sealing element encircling this passage opening is referenced to as sealing element 35. This sealing element represents the sealing elements 35*a* to 35*d*, as they are shown in FIG. 9. Corresponding reference numbers are used in the following descriptions for all elements.

FIG. 10 shows a top view to a passage opening 32 after socket expansion, at the surface of the gasket carrier 3 that is facing away from the terminal plate 2. In this view, the folded-over tabs of a slit side-wall socket 21 can be seen. These individual tabs are referenced to with reference number 23, 23' and 23". The socket 21 is comparable to the slit sockets 21*a* to 21*d* depicted in FIG. 9.

Figure 11:
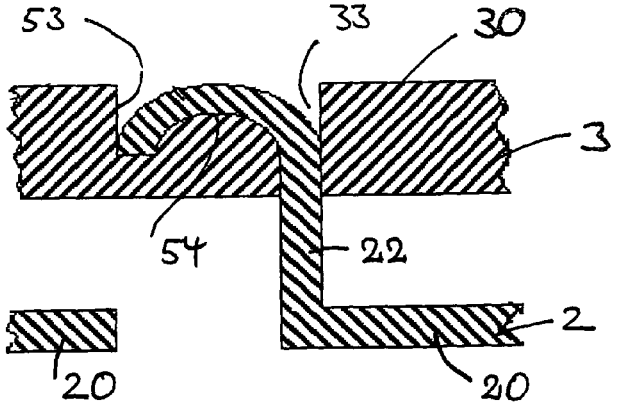

FIG. 11 shows a sectional view through the gasket carrier plate 3, after assembly and folding over of tabs 22, through slit openings 33. Here, a slit-shaped opening 33, representative for slit-shaped openings 33*a* to 33*d* of all preceding figures is shown. This slit opening 33 includes a recessed stepped structure, such that its outwardly facing opening width 53 corresponds approximately to the length of the folded over portion of the tab 22; and where the tab itself is a tabular extension of the terminal plate 2 as described previously. The stepped structure includes a cambered or convex shaped feature 54 as shown in this Figure, so that together the recessed opening 53 and cambered feature 54 serve as a ledge or receptacle to receive the folded over end of lug 22, during assembly of the terminal plate 2, to the gasket carrier plate 3. That is, during assembly of the gasket carrier plate 3 onto the terminal plate 2, the tabs 22 are first guided through the slit opening 33 and then bent onto and against the cambered surface 54. This results in a clamped connection between the lugs 22 and base plate 30, in which the achieved joint is counter sunk below surface of gasket carrier plate 3.

Figure 12:
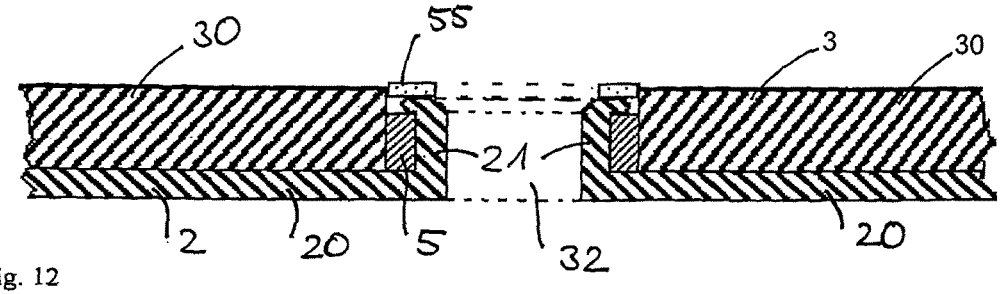

FIG. 12 shows an example of the design of the passage opening 32 representative for all passage openings shown in the foregoing figures. In the opening of the facial base plate 30 of the gasket carrier plate 3 a sleeve 5 is provided, which extends along the axial length of this opening starting from its end pointing towards the terminal plate 2, and ending at a predetermined distance slightly below the surface of the facial base plate 30 that is facing away from the terminal plate 2. A socket 21 has been inserted into this sleeve so that the facial base plate 30 rests against the terminal plate 2. The socket 21 has then been bulged and folded over above the upper end (as shown here) of sleeve 5, so that the socket adjoins to the sleeve 5 in a form- and force-locking manner. The relative heights of the sleeve 5 and the socket 21 are such that the surface of the facial base plate 30 pointing away from the terminal plate 2 is situated above the surface of the socket 21, when the socket end is fully expanded. In the interspace between the facial base plate surface and that of the expanded socket end just described, an annular gasket 55 is inserted, which seals between the facial base plate 30 and the socket 21. Adequate selection of the height of the annular seal 55 also enables a fluid-tight seal against the part to which the gasket carrier plate 3 is fastened to, i.e. when the carrier plate is bolted to the mating part to which it is mounted.

FIG. 12 demonstrates that the annular gasket 55 does not necessarily have to be arranged on the surface of the facial base plate 30. It is also possible to arrange the annular gasket 55 only adjacent to this surface, as is shown here. The annular gasket 55 completely encircles the circumferential edge of the opening 32 in the facial base plate 30. While in FIGS. 1 to 11, the circumferential edge of the opening 32 is encircled by a sealing element outside this circumferential edge, in FIG. 12, the gasket is inside this circumferential edge. Nevertheless, the sealing function along the circumferential edge of the facial base plate 30 is achieved in either case.

Figure 13:
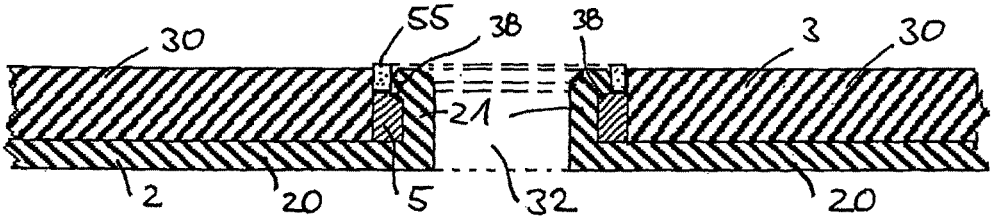

FIG. 13 shows a further embodiment of a passage opening 32, after socket assembly and expansion. A sleeve has again been inserted into this passage opening 32 in FIG. 13, which at its upper end has a chamfer 38. Here again, the socket 21 at its upper end pointing away from the terminal plate 2 has been bent and folded over. In doing so, the socket material is swaged against and follows the surface contour of the sleeve 5, especially of the chamfer 38. In this case, the upper edge of the socket in FIG. 13 is flush with the surface of the facial base plate 30 that is facing away from the terminal plate. As there is no space available for arranging a gasket 55 above the socket 21 in this embodiment, the bendable length of the socket 21 is controlled in such a way that a free space is maintained between the outer end of the socket 21 and the passage opening 32 in the facial base plate 30, into which an annular gasket 55 has been pre-placed. In this way, the sealing element is also locked in place, and again, its thickness can be predetermined to provide a reliable seal between the carrier plate 30, and the part to which the carrier plate is fastened.

FIG. 14 shows in three partial figures—a plan view in FIG. 14-*a* and sectional views in FIGS. 14-*b* and 14-*c*—a further embodiment of the gasket carrier plate 3. Here, it comprises metallic inserts 70*a*, 70*b*, 70*b*' and 70*c* defining the passage openings 32*a*, 32*b*, 32*b*' and 32*c* for the sockets and act as a carrier for the actual sealing elements 35*a*, 35*b*, 35*b*' and 35*c* which are moulded onto the metallic inserts 70*a* to 70*c*. Each sealing element 35*a* to 35*c* encircles one of the passage openings 32*a* to 32*c*. While insert 70*a* has a circular shape and therefore the highest flexibility in installation, inserts 70*b* and 70*b*' have mirror symmetry. In contrast, insert 70*c* has a waisted shape without any symmetry. Inserts 70*b* and 70*b*' demonstrate that the embodiment of the invention using inserts allows for a modular design, as for both passage holes, 32*b* and 32*b*', identical inserts are used. This design also allows to use inserts of different thicknesses in one gasket carrier plate. Further, it is possible to use different materials for the sealing elements of the different inserts, e.g. sealing elements being better suited for oil or for water-glycol mixtures and the like.

In addition to the slits 33 already know from the previous embodiments, the gasket carrier plate 3 here also shows dome-shaped protrusions 33* which can take-up mounting elements formed in the terminal plate of the heat exchanger plate stack, e.g. embossments. The interaction may be comparable to a snap fastener.

As can be seen in FIG. 14-*b*, which corresponds to section A-A in FIG. 14-*a*, a sealing element 36 is situated at the opposite surface of the gasket carrier plate 3, immediately opposite to the sealing element 35. These two sealing elements provide for the complete sealing of the respective passage of a socket so that the socket itself does not need to be designed with respect to sealing purposes. FIG. 14-*b* further shows that the insert 70 has been cut from a plane metal sheet. In its region encircling the passage opening 32*c*, sealing elements 35 and 36 have been moulded to the facial surfaces of the insert 70. These sealing elements 35 and 36 are located close to the passage opening 32*c* but distanced to the latter. At their outer edge, the inserts 70 are integrated into the polymer material 71 of the gasket carrier plate 3. This is done by moulding the polymer material onto the insert and results in the transition area 72 where the polymer material 71 covers the insert 70 on both surfaces. FIG. 14-*b* also demonstrates that the insert 70 in its region with the sealing elements 35, 36 shows the largest height, H3, the polymer material an intermediate height, H2 and the metal sheet of the insert 70 the smallest height, H1. As the height H2 of the polymer material 71 and therefore of the largest part of the gasket carrier plate 3 is smaller than the height H3 of the insert with the sealing elements 35, 36, the latter cannot be fully compressed. This provides for a long-term stability of the sealing elements 35 and 36.

FIG. 14-*c* shows an alternative embodiment in a comparable sectional view as in FIG. 14-*b* where the sealing elements 35 and 36 are however applied at the edge of the insert 70 by edge moulding and therefore also cover the edge of the insert 70. They are nevertheless considered as first and second sealing element.

While both FIGS. 14-*b* and 14-*c* show embodiments where sealing elements 35 and 36 show the same thickness, it is also possible to design them with different heights or to crank the insert in order to adapt the sealing height to the particular needs of a particular type of heat exchanger.

What is claimed is:

1. A heat exchanger, comprising:

a stack of heat exchanger plates defining alternating flow paths for a first fluid and a second fluid, the plate stack having first and second ends, with one of said heat exchanger plates being a first terminal plate located at the first end of the plate stack, and another of said heat exchanger plates being a second terminal plate located at the second end of the plate stack, wherein the first terminal plate includes at least one opening for inlet or release of at least one of said first and second fluids into or from the plate stack, wherein each said opening in the first terminal plate is surrounded by a tubular socket, each said socket projecting from the first terminal plate in a direction away from the plate stack, a first gasket carrier plate having a first lateral face in direct facing contact with the first terminal plate, an opposed second lateral face, and at least one fluid passage opening leading from the first to the second lateral face, wherein each of the at least one fluid passage openings is positioned in the first gasket carrier plate to align with one of the openings and tubular sockets of the first terminal plate, such that the at least one socket of the first terminal plate is received in the at least one opening of the first gasket carrier plate, at least one first elastomeric sealing element arranged on the first lateral face of the first gasket carrier plate between the first terminal plate and the first gasket carrier plate, each said first elastomeric sealing element completely encircling one of said fluid passage openings and sealing the fluid passage opening between the first terminal plate and the first gasket carrier plate, at least one second elastomeric sealing element arranged on the second lateral face of the first gasket carrier plate, each said second elastomeric sealing element completely encircling one of said fluid passage openings, wherein each said tubular socket has a proximal end at which it is joined to the first terminal plate and an opposed free end which bulges radially outwardly against a wall of one of said fluid passage openings to lock the plate stack into sealed engagement with the first gasket carrier plate, and wherein the sealing of the at least one fluid passage opening between the first terminal plate and the first gasket carrier plate is provided by compression of the at least one elastomeric sealing element directly against the first terminal plate.

2. The heat exchanger according to claim 1, wherein the second terminal plate includes at least one opening for inlet or release of at least one of said first and second fluids into or from the plate stack, wherein each said opening in the second terminal plate is surrounded by a tubular socket, each said socket projecting away from the second terminal plate in a direction away from the plate stack, wherein the heat exchanger further comprises:

a second gasket carrier plate having a third lateral face in direct facing contact with the second terminal plate, an opposed fourth lateral face, and at least one fluid passage opening leading from the third to the fourth lateral face, wherein each of the at least one fluid passage openings is positioned in the second gasket carrier plate to align with one of the openings and tubular sockets of the second terminal plate, such that the at least one socket of the second terminal plate is received in the at least one opening of the second gasket carrier plate, at least one third elastomeric sealing element arranged on the third lateral face of the second gasket carrier plate between the second terminal plate and the second gasket carrier plate, each said third elastomeric sealing element completely encircling one of the fluid passage openings of the second gasket carrier layer and sealing the fluid passage opening between the second terminal plate and the second gasket carrier plate, at least one fourth elastomeric sealing element arranged on the fourth lateral face of the second gasket carrier plate, each said fourth elastomeric sealing element completely encircling one of the fluid passage openings of the second gasket carrier layer on the fourth lateral face.

3. The heat exchanger according to claim 1, wherein each of the at least one first and second elastomeric sealing elements is moulded from a polymer material onto one of the first and second lateral faces of the first gasket carrier plate.

4. The heat exchanger according to claim 3, wherein each of the at least one first and second elastomeric sealing elements is at least partially located in a groove in the first or second lateral face.

5. The heat exchanger according to claim 4, wherein the first gasket carrier plate consists of or comprises a polymer material.

6. The heat exchanger according to claim 5, wherein the first gasket carrier plate further comprises a plurality of fastening openings, and wherein a metallic sleeve is inserted into at least one of the at least one fluid passage openings and at least one of the fastening openings of the first gasket carrier plate.

7. The heat exchanger according to claim 6, wherein each said metallic sleeve protrudes beyond a circumferential edge of said fluid passage opening on the first lateral face of the first gasket carrier plate, in a direction orthogonal to a plane of the first gasket carrier plate.

8. The heat exchanger according to claim 7, wherein the first gasket carrier plate is moulded from a polymer material and at least one metal sheet insert is integrated in the polymer material.

9. The heat exchanger according to claim 8, wherein each of the at least one metal sheet insert comprises one of the fluid passage openings and carries the first and second elastomeric sealing elements on its opposed facial surfaces with each of the first and second elastomeric sealing elements completely encircling the fluid passage opening.

10. The heat exchanger according to claim 1, wherein the first gasket carrier plate is provided with at least one lattice bars and ribs for structural reinforcement of the first gasket carrier plate, the lattice bars or ribs being located in recesses between the first and second lateral faces.

11. The heat exchanger according to claim 1, wherein the first gasket carrier plate comprises at least one fastening opening for fastening the heat exchanger to another part.

12. The heat exchanger according to claim 11, wherein an area of the first gasket carrier extends outwardly beyond the edges of the first terminal plate, in the plane of the first gasket carrier plate, with at least one of the fastening openings being arranged in the outwardly extending area.

13. The heat exchanger according to claim 1, wherein the free end of at least one of the tubular sockets protrudes beyond the second lateral face of the first gasket carrier plate.

14. The heat exchanger according to claim 13, wherein the free end of at least one of the tubular sockets of the first terminal plate is folded over outwardly by an angle of 30° to 120° with respect to the remainder of the tubular socket.

15. The heat exchanger according to claim 14, wherein said at least one of the tubular sockets of the first terminal plate at least partially covers the second elastomeric sealing element.

16. The heat exchanger according to claim 15, wherein the folded over free end of said at least one of the tubular sockets includes slits or a saw-tooth edge, which is folded over partially.

17. The heat exchanger according to claim 1, wherein the first terminal plate is provided with a plurality of tabs which protrude from the plane of the first terminal plate in the direction of the first gasket carrier plate, and the first gasket carrier plate is provided with a plurality of slits extending through the first gasket carrier plate from the first lateral face to the second lateral face, wherein the tabs are received in the slits in the first gasket carrier plate, with the tabs having ends which are folded over to provide a locking mechanical attachment orthogonal to the plane of the first gasket carrier plate, between the first gasket carrier plate and the heat exchanger.

18. The heat exchanger according to claim 17, wherein said locking mechanical attachment between the first gasket carrier plate and said heat exchanger results in a pressure on the first elastomeric sealing element in an axial direction along said at least one fluid passage opening and said at least one socket, which pressure is orthogonal to a contact face between said first gasket carrier plate and said first terminal plate.

* * * * *